US006976327B2

(12) United States Patent
Goodin et al.

(10) Patent No.: US 6,976,327 B2
(45) Date of Patent: Dec. 20, 2005

(54) SAFE AND SECURE BABY IDENTIFICATION SYSTEM

(75) Inventors: Teresa S. Goodin, Baton Rouge, LA (US); Mary Ann Temples, Keithville, LA (US)

(73) Assignee: Teresa Goodin, Lafayette, LA (US)

( * ) Notice: Subject to any disclaimer, the term of this patent is extended or adjusted under 35 U.S.C. 154(b) by 9 days.

(21) Appl. No.: 10/702,763

(22) Filed: Nov. 6, 2003

(65) Prior Publication Data

US 2004/0098896 A1 May 27, 2004

Related U.S. Application Data

(63) Continuation-in-part of application No. 10/012,927, filed on Oct. 22, 2001, now Pat. No. 6,655,063.

(51) Int. Cl.[7] ..... A44C 5/00; G09F 3/14
(52) U.S. Cl. ..... 40/63; 40/665
(58) Field of Search ..... 40/665, 633

(56) References Cited

U.S. PATENT DOCUMENTS

| | | | | | |
|---|---|---|---|---|---|
| 2,871,592 | A | * | 2/1959 | Polzin | 40/633 |
| 2,911,743 | A | * | 11/1959 | Pokras | 40/633 |
| 3,197,899 | A | * | 8/1965 | Twentier | 40/633 |
| 3,279,107 | A | * | 10/1966 | Baumgartner | 40/633 |
| 4,377,887 | A | * | 3/1983 | Valestin | 24/16 PB |

* cited by examiner

*Primary Examiner*—Cassandra Davis

(57) ABSTRACT

A human baby identification system including identification bracelets for attachment to the wrist or ankle of a baby, each of the identification bracelets including a pocket portion for receipt of an identification card, an identification number imprinted on the bracelets, a flexible fastening strap connected to the pocket portion having a plurality of ratchet teeth thereon, a sleeve for enclosing a portion of the strap, and a hollow latch assembly for receiving and securing the flexible fastening strap around the wrist or ankle of the baby, the latch assembly having a locking cam which engages the ratchet teeth to enable the fastening strap to be moved in one direction only to tighten the fastening to prevent the fastening strap from being loosened on the baby.

6 Claims, 6 Drawing Sheets

SAFE AND SECURE BABY IDENTIFICATION SYSTEM

CROSS REFERENCE TO RELATED APPLICATIONS

This application is a continuation-in-part of our patent application Ser. No. 10/012,927 filed Oct. 22, 2001 now U.S. Pat. No. 6,655,063.

BACKGROUND OF THE INVENTION

1. Field of the Invention

The present invention relates to a baby identification system, bracelet, and bracelet assembly for attachment to a baby's wrist or ankle and to the mother's wrist after delivery. The system of the invention is used in neonatology units to identify a newborn baby and the mother of the baby immediately after the baby is delivered.

2. Description of the Prior Art

Experienced registered nurses appreciate the importance of providing their patients with a safe environment. Presently, the most commonly used baby identification system used for newborns and their mothers is rapidly proving itself deficient and dangerous. The commonly used system includes three soft plastic bracelets that fasten to the wrist or ankle via a buttonhole method, or by a metal clamp. Two of the three bracelets are attached to the wrist or ankle of a baby and the other bracelet to the mother's wrist immediately after delivery. All three bracelets are provided with an identical identification number.

This most commonly used method for identifying babies and linking them to their mother is failing on a daily basis in neonatology units. It is well known that the outside diameter of the flesh around the wrists and ankles of a baby is larger immediately after delivery than within a day or two. The commonly used baby identification bracelets frequently slip from the ankles and wrists of babies as they decrease in size after birth. Such bracelets become lost in the linens used by a baby and in the linens on the bed of the mother. Most alarmingly, such commonly used bracelets are frequently found lying on the floor of neonatology units, and the babies who wore the lost bracelets have no written identification attached thereto. Nurses are forced to check for identification bands at the beginning and end of their shift. If one bracelet is missing from the baby, a new set of bracelets must be applied to the mother and baby because each set of three bracelets has a distinct, common identification number printed on each of the three bracelets in the set. Such searching procedures and bracelet replacement procedures are time-consuming and expensive.

With the increasing and widespread number of infant abductions and "baby switching", any chance of error in identifying babies should be eliminated or reduced to the minimum. Parents are becoming concerned and have started questioning the safety and security of their most precious possession, their baby. With the commonly used buttonhole or metal clamp systems for attaching baby identification bracelets to a baby, the bracelets are either attached too loosely and allow them to slip from the wrist or ankle of the baby, or the baby identification bracelets are attached too tightly and cause the edges of the plastic bracelets to "cut into" the delicate skin on the wrist and ankle of the baby wearing the bracelets.

When a critically ill premature baby is admitted to the neonatal intensive care unit, the medical team's first thought is saving the baby's life. This is a crucial time when the identity of the baby is not the highest priority. Commonly available identification bracelets which are too large for the premature baby are quickly taped to the bed of the baby and remain there for weeks until the baby "grows into" the bracelets. During the period of time that the baby has no bracelet attached, the baby is commonly referred to by neonatal personnel as "Jane or John Doe". No identification remains with the premature baby too small for attachment of an identification bracelet when the baby is removed from its bed. There is thus a need for a baby identification bracelet that can be adjusted to fit the wrists and ankles of a premature baby.

Occasionally a mother is discharged from a hospital before her baby is released from the nursery or neonatal intensive care unit. This separation may be due to a premature birth requiring a lengthy hospital stay, neonatal infection, or other medical necessity. There is a need in the art for a baby identification system to include a family member other than the mother to link the family member to the baby in the event the mother must leave the baby in the hospital due to the illness of the baby, or her illness may require her removal from the hospital while her baby remains. Furthermore, the mother's decease shortly after childbirth may leave her baby in a medical facility with no other family member linked to the identification number on the baby's identification bracelet.

Baby identification bracelets and identification systems are well-known in the art. Patents of the related art of which applicants are aware are the following U.S. Pat. Nos.: 1,517,456; 3,106,028; 3,214,808; 4,272,900; 4,499,680; 4,506,415; 4,833,807; 6,212,808, D250,423; D255,668; D257,562; D261,905; and D368,231.

BRIEF SUMMARY OF THE INVENTION

It is an object of the invention to provide a baby identification system which is virtually fail-proof.

It is a further object of the invention to provide a baby identification bracelet which can be tightened but cannot be loosened while attached to the wrist or ankle of a baby.

It is an additional object of the invention to provide a baby identification bracelet which will not slide from the wrist or ankle of the baby.

It is another object of the invention to provide a set of four baby identification bracelets having a common identical identification number imprinted thereon to enable a baby to wear two of the four bracelets, the mother to wear one of the four bracelets, and the father to wear one of the four bracelets, thereby enabling the father and mother to be linked to a baby.

In accordance with the present invention there is provided a baby identification system including a set of bracelets for placement on the ankle or wrist of the baby and on the mother, each bracelet having a pocket portion for placement of an identification card for the baby, a common identification number, a flexible fastening strap connected to the pocket portion, the flexible fastening strap having a plurality of ratchet teeth thereon, and a locking mechanism for receiving and securing the flexible fastening strap, the locking mechanism having a plurality of ridges which are engaged by a cam to enable the fastening strap to be moved in one direction only therein to tighten the fastening strap about a wrist or ankle and preventing the fastening strap from being loosened on a wrist or ankle.

In another embodiment of the invention, a bracelet is provided with an enlarged pocket portion for receipt of the pocket portion cut from the first embodiment of the bracelet of the invention.

In an additional embodiment of the invention, an additional bracelet is provided in the set for placement on the wrist of the father of the baby, or on the wrist of a designated party.

DETAILED DESCRIPTION OF THE INVENTION

Figure 1:
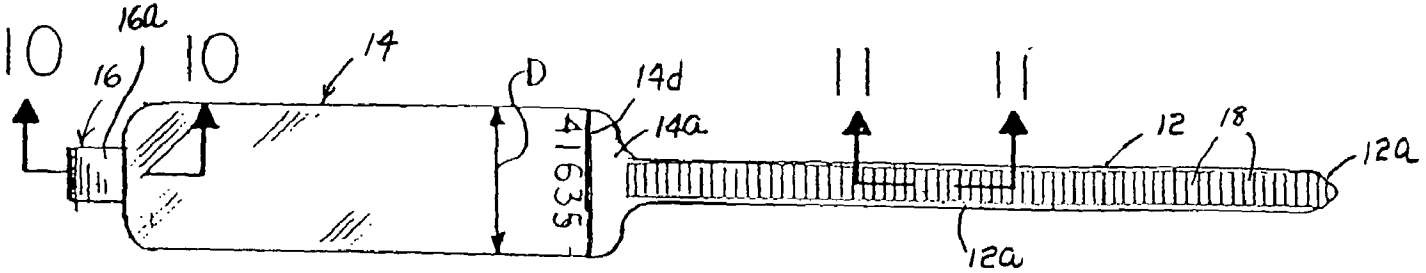
FIG. 1 is a top plan view of a first embodiment of the bracelet of the invention.
Figure 2:
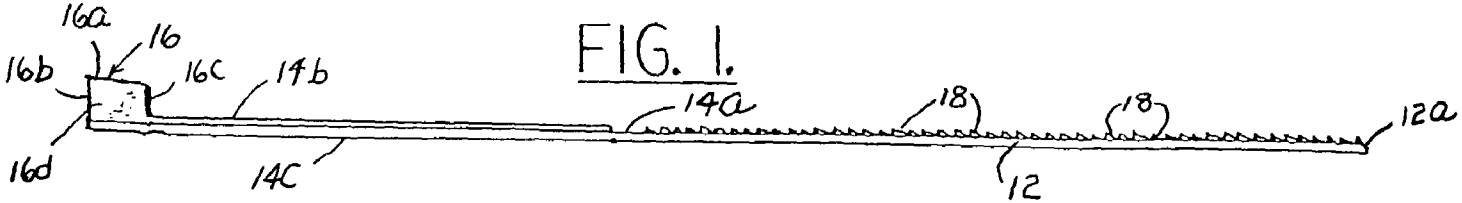
FIG. 2 is a side plan view of the bracelet of FIG. 1.

Referring now to the drawings, and in particular FIGS. 1, 2, 4–6, 10, 10A, and 11, there is shown an identification bracelet of the invention generally indicated by the numeral 10. The bracelet 10 includes an elongated flexible fastening strap generally indicated by the numeral 12 which is rigidly connected to the pocket portion generally indicated by the numeral 14. Pocket portion 14 has a latch assembly generally indicated by the numeral 16 connected thereto.

Pocket portion 14 has a generally rectangular base 14*c* which is preferably integrally formed with strap 12. The width of rectangular base 14*c* is indicated by the letter D in FIG. 1. Connected to the top side 14*a* of pocket portion 14 is a flap 14*b* which cooperates with the top side 14*a* of pocket portion 14 to form a pocket or slot 17 shown in FIGS. 10 and 10A having an entrance edge 14*d* for receipt of an identification card or paper 14*e* shown in FIGS. 6 and 7 having selected indicia 15 printed or typed thereon after the birth of a baby which identifies the baby to which the bracelet of the invention is attached. Such indicia may include any desired data such the name of the baby, name of the mother of the baby, date of birth of the baby, and the like. An identification number, "41635" shown in FIGS. 1, 4, 5, 7, and 9, is printed on the top side 14*a* of base 14*c*.

Figure 10:
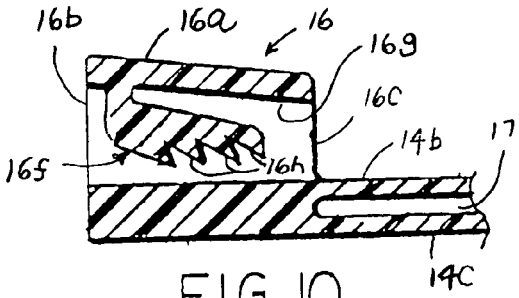
FIG. 10 is a cross-sectional view taken along lines 10—10 of FIG. 1.
Figure 10A:
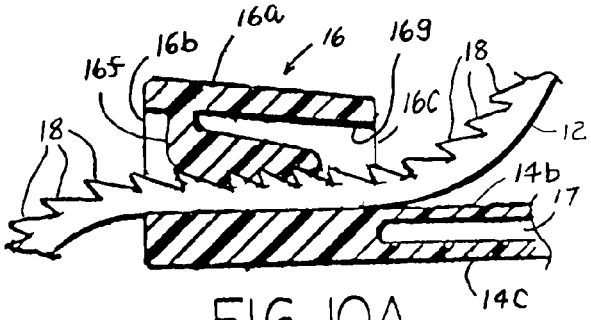
FIG. 10A is a cross-sectional view taken along lines 10—10 of FIG. 1 showing the fastening strap of the bracelet of the invention received in the latch of the bracelet of the invention.
Figure 11:
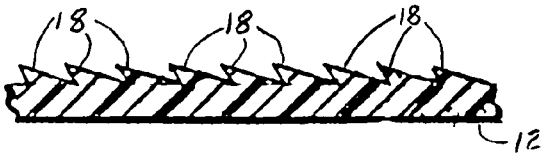
FIG. 11 is a cross-sectional view of the fastening strap of the bracelet of the invention taken along lines 11—11 of FIG. 1.

Ratchet teeth 18 are located on the top side 12*a* of fastening strap 12. As shown in FIG. 10*a* and FIG. 10*a*, fastening strap 12 and ratchet teeth 18 are selectively received in latch assembly 16. Latch assembly 16 can be seen to be hollow inside with a generally rectangular top 16*a*, an opening 16*b* in the outer end thereof for receipt of front end of strap 12, an opening 16*c* in the inner end for exit of the preferably tapered front end 12*a* of strap 12, and parallel side walls 16*d* and 16*e*.

A locking cam generally indicated by the numeral 16*f* is located inside of latch assembly 16 and is connected to bottom side 16*g* of top 16*a*. Locking cam 16*f* has ratchet teeth 16*h* which mate with ratchet teeth 18 as shown in FIG. 10A and prevent strap 12 from moving backward from latch assembly 16 when inserted therein.

Figure 6:
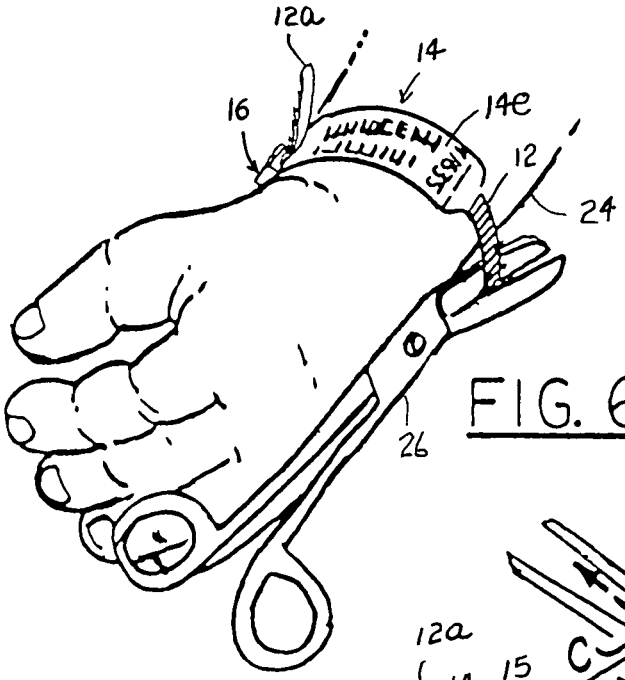
FIG. 6 is a perspective view of a bracelet of the invention attached to the wrist of a baby with scissors positioned for cutting the fastening strap of the bracelet to remove it from the baby.

Baby identification bracelet 10 is attached to one wrist, and preferably one ankle of the baby, as shown in FIG. 6. To attach the baby identification bracelet to the wrist or ankle of a baby, the base 14*c* of the pocket portion of the bracelet 10 is placed against the wrist or angle of a baby, the strap 12 is wrapped around the wrist or ankle of the baby, and the end 12*a* of the strap is inserted into opening 16*b* in latch assembly 16 and extended through latch assembly 16 until the end 12*a* of strap 12 extends from opening 16*c* as indicated in FIG. 10A. The end of strap 12 is then pulled away from opening 16*c* of latch assembly 16 until bracelet 10 is fitted snugly around the wrist or ankle of the baby. If the outside diameter of the flesh around the wrist and/or ankle of baby upon which bracelet 10 is placed decreases after placement of the bracelet 10 thereon, the bracelet may be easily tightened by pulling the strap 12 farther through latch assemble 16 to tighten bracelet 10 snugly around the wrist and/or ankle of the baby. Bracelet 10 cannot be removed from the baby except by cutting as described below.

Preferably, elongated flexible fastening strap 12, pocket portion 14, flap 14*b*, and latch assembly 16 are made from a flexible plastic material such as a thermoplastic or thermosetting organic polymer.

Figure 4:
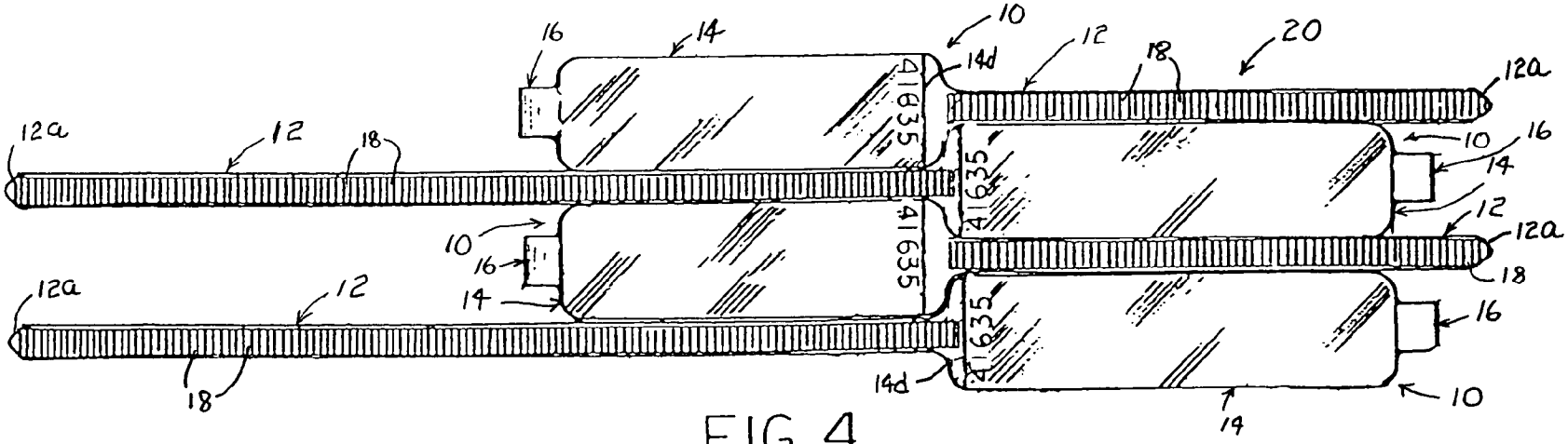
FIG. 4 is a top plan view of a first set of bracelets of the invention.
Figure 5:
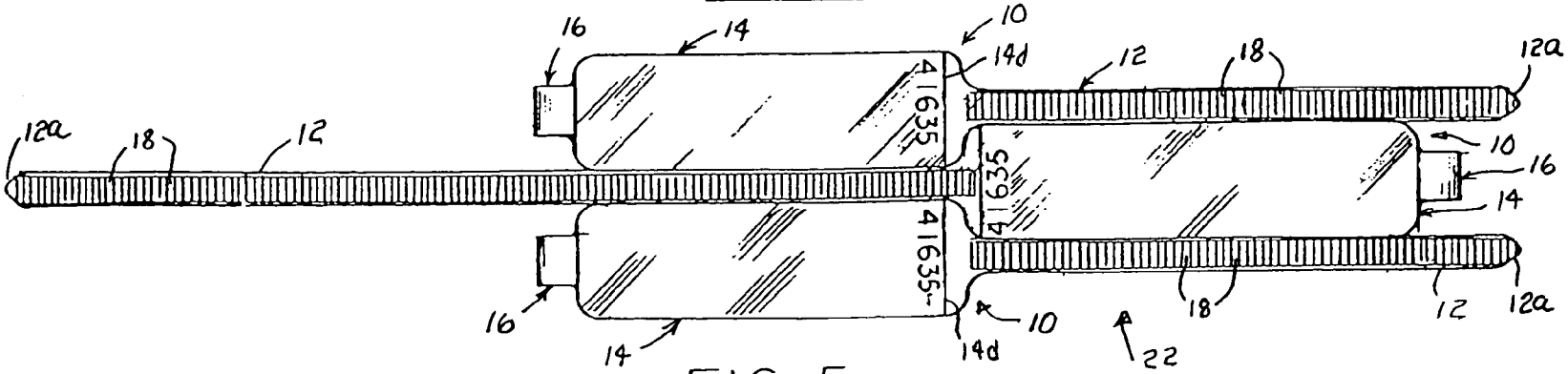
FIG. 5 is a top plan view of a second set of bracelets of the invention.

As shown in FIGS. 4 and 5, the baby identification bracelets 10 of the invention are packaged in groups of four as generally indicated by the numeral 20 in FIG. 4 and groups of three as generally indicated by the numeral 22 in FIG. 5. The individual baby identification bracelets 10 of the invention are lightly bonded at their edges as shown in FIGS. 4 and 5 as is known in the art to enable each of the bracelets 10 to be easily separated by the fingers of the user from the other bracelets in the group.

The three bracelets in the group 22 shown in FIG. 5 are used when it is desired to place two bracelets on a baby and one on the mother. The four bracelets in group 20 shown in FIG. 4 are used when it is desired to place two bracelets on a baby, one bracelet on the mother, and one bracelet on the father or other designated party.

Figure 3:
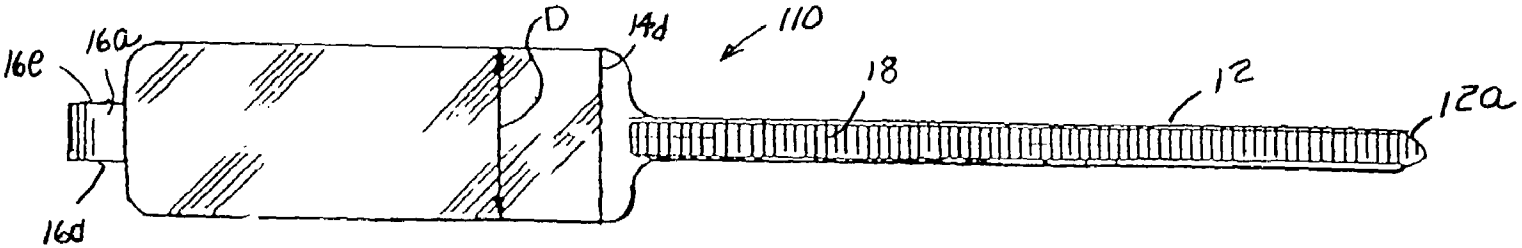
FIG. 3 is a top plan view of a second embodiment of the bracelet of the invention having a larger pocket portion than the bracelet shown in FIG. 1.
Figure 7:
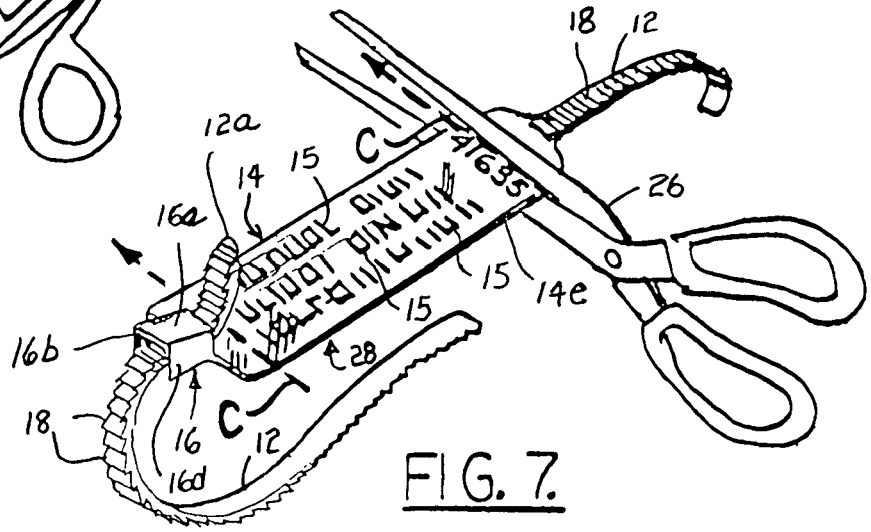
FIG. 7 is a perspective view of the bracelet shown in FIG. 6 after being cut and removed from the arm of a baby with scissors positioned to cut the pocket portion of the bracelet to remove a written identification card therefrom for placement in the bracelet shown in FIG. 3 and FIG. 8.
Figure 8:
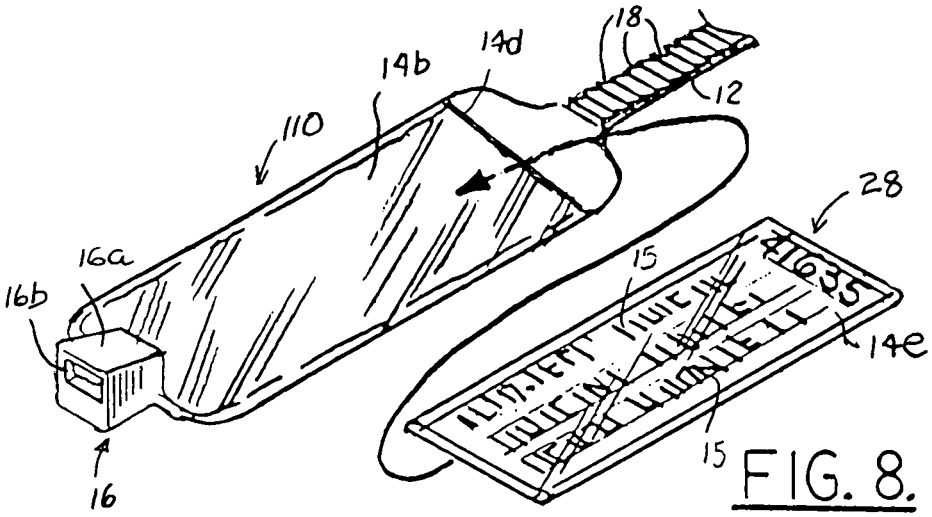
FIG. 8 is a perspective view, partly cut-away, of the bracelet of FIG. 3 of the invention showing the pocket portion with identification card removed from the bracelet shown in FIG. 7 being aligned for insertion therein.
Figure 9:
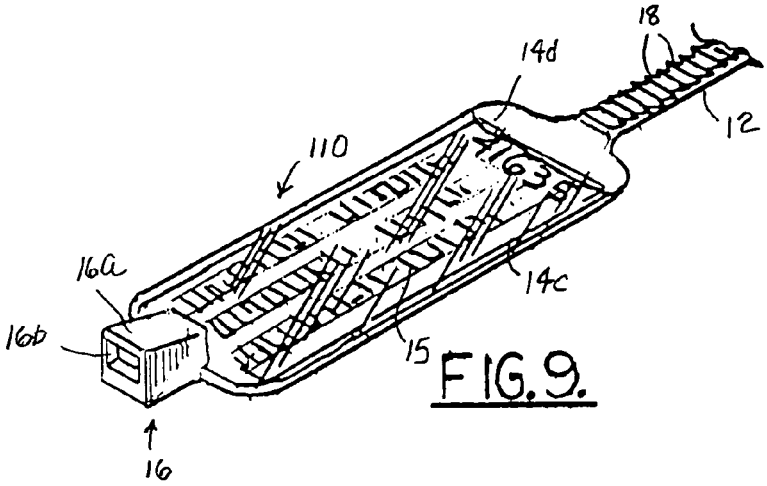
FIG. 9 is a perspective view, partly cut away, of the bracelet of FIG. 3 of the invention having an identification tag inserted therein.

In FIGS. 3, 8, and 9 there is shown a baby identification bracelet 110 which has a width indicated by the letter D which is larger than the width indicated by the letter D in FIG. 1 shown for bracelet 10. The strap 12, teeth 18, latch assembly 16 and other elements are identical to bracelet 10 with the exception that there is no identification number imprinted thereon. Baby identification bracelet 110 is used to receive a pocket portion 14 as shown by the arrow in FIG. 8 containing an identification card 14*e* and identification number such as "41635" from an identification bracelet 10 that has been removed from a baby as shown in FIG. 6 and FIG. 7. As shown in FIG. 6, pocket portion 14 of bracelet 10 is removed from the wrist 24 of a baby by cutting strap 12 with scissors 26. As shown in FIG. 7, pocket portion 14 is then cut along lines C—C with scissors 26 to remove the portion 28 of pocket portion 14 containing the identification card 14*e* and identification number 41635. Portion 28 is then placed in baby identification bracelet 110 as shown by the arrow in FIG. 8 and in FIG. 9. An identification bracelet may be removed from a baby because of the growth of the baby, enlargement of the wrists or ankles of a baby due to swelling, damage to the bracelet, or for any other desired reason. Identification bracelet 110 can then be attached to the wrist or ankle of the same baby from which a bracelet 10 has been removed.

Figure 12:
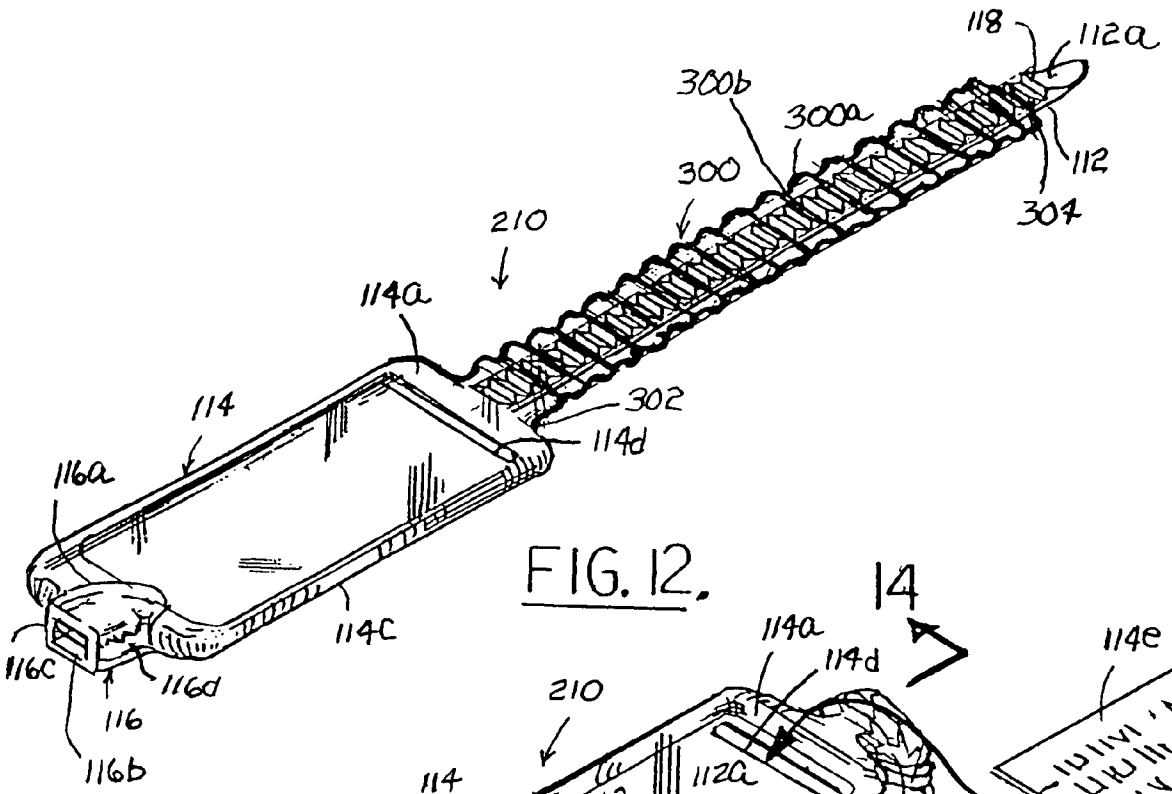
FIG. 12 is a top perspective view of a third embodiment of the bracelet of the invention extended in the open position prior to attachment to the wrist of the wearer.
Figure 13:
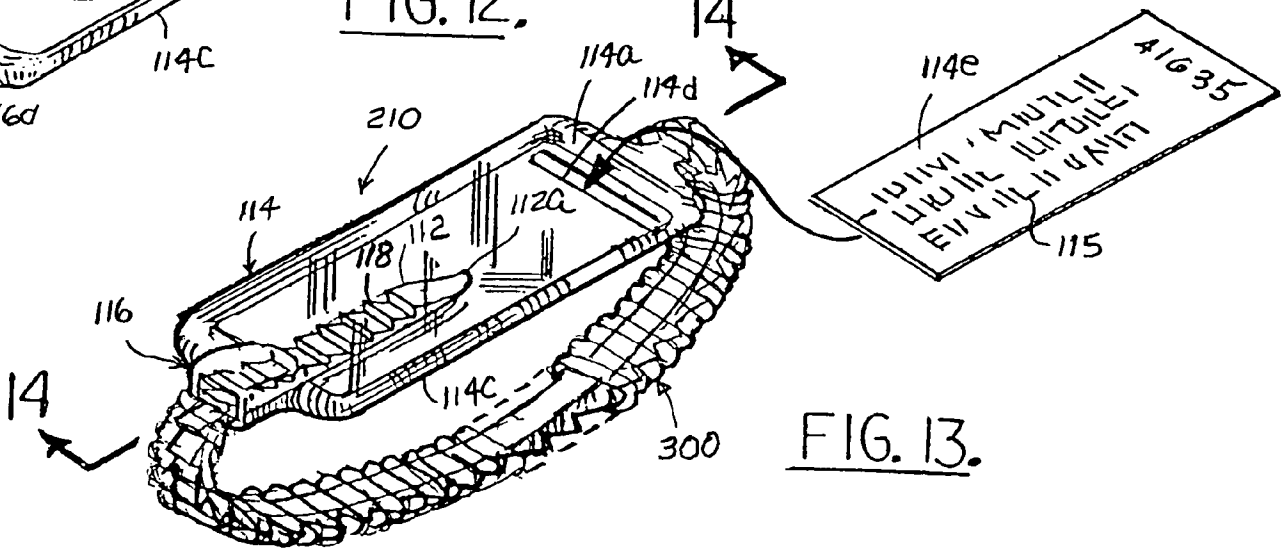
FIG. 13 is a top perspective view of the third embodiment of the bracelet of the invention in the closed position after attachment to the wrist of the wearer.
Figure 14:
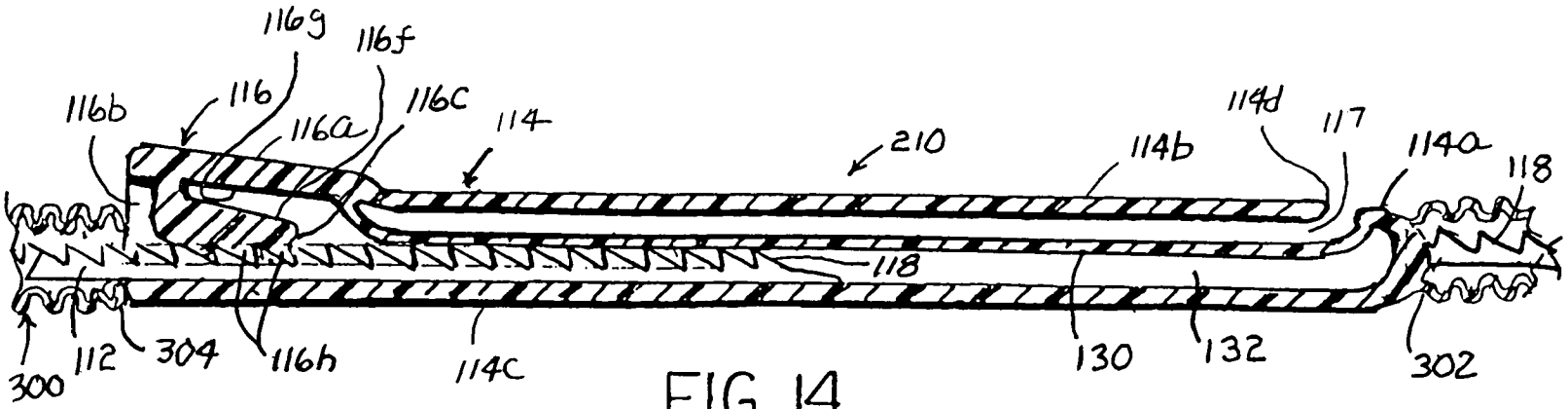
FIG. 14 is a cross-sectional view of the bracelet of FIG. 13 taken along lines 14—14 of FIG. 13.

Referring now to FIGS. 12–14, there is shown a third embodiment of the identification bracelet of the invention generally indicated by the numeral 210. The bracelet 210 includes an elongated flexible fastening strap generally indicated by the numeral 112 which is rigidly connected to the pocket portion generally indicated by the numeral 114. Pocket portion 114 has a latch assembly generally indicated by the numeral 116 connected thereto.

Pocket portion 114 has a generally rectangular base 114*c* which is preferably integrally formed with strap 112. Connected to the top side 114*a* of pocket portion 114 is a flap 114*b* which cooperates with the top side 114*a* of pocket portion 114 to form a pocket or slot 117 shown in FIGS. 14 and 15 having an entrance edge 114*d* for receipt of an identification card or paper 114*e* shown in FIGS. 13 and 15 having selected indicia 115 printed or typed thereon after the birth of a baby which identifies the baby to which the bracelet of the invention is attached. Such indicia may include any desired data such the name of the baby, name of the mother of the baby, date of birth of the baby, and the like. An identification number "41635" shown in FIG. 13 may be printed on the top side 114*a* of base 114*c* and on the top side of identification card or paper 114*e*.

Figure 15:
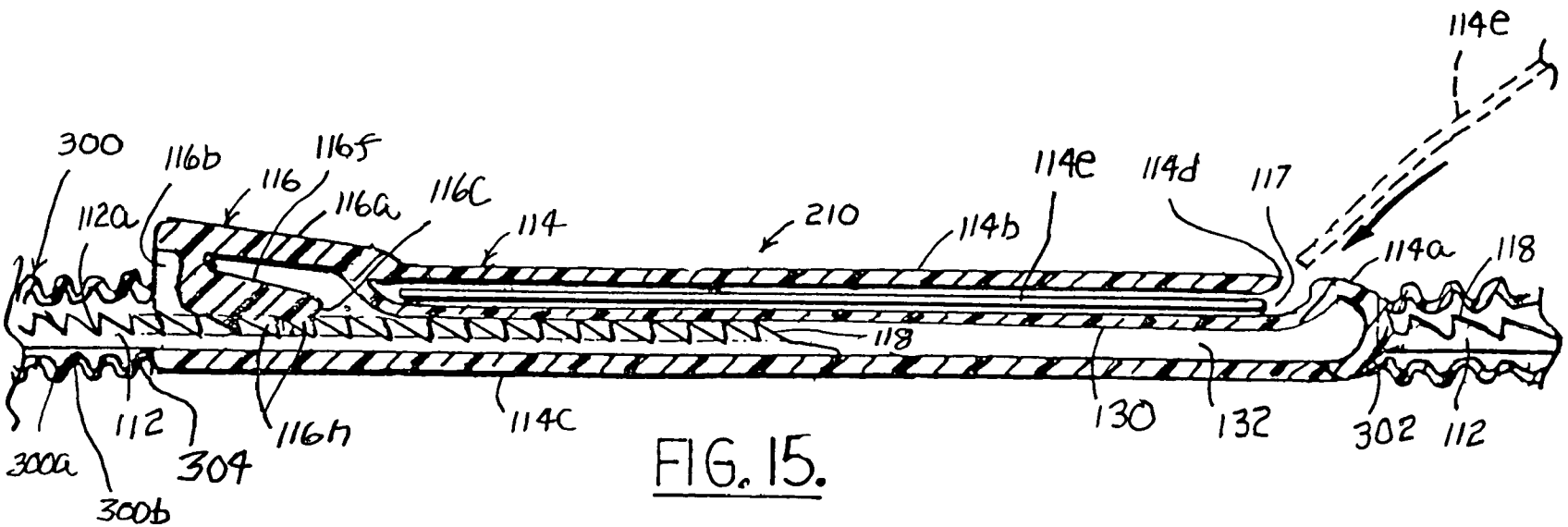
FIG. 15 is a cross-sectional view of the bracelet of FIG. 13 taken along lines 14—14 of FIG. 13 showing an identification card or paper therein and an identification card or paper in phantom lines aligned for insertion therein.

A generally rectangular inner wall 130 is located beneath flap 114*b* and forms the bottom of pocket or slot 117. Inner wall 130 is spaced apart from rectangular base 114*c* is generally parallel thereto. Inner wall 130 is preferably the same width as rectangular base 114*c* and cooperates therewith to form pocket 132 for receipt of the outer end of strap 112 as shown in FIGS. 14 and 15.

Ratchet teeth 118 are located on the top side 112*a* of fastening strap 12. As shown in FIGS. 13–15, fastening strap 112 and ratchet teeth 118 are selectively received in latch assembly 116. Latch assembly 116 can be seen to be hollow inside with a generally rectangular top 116*a*, an opening 116*b* in the outer end thereof for receipt of front end of strap 112, an opening 116*c* in the inner end for exit of the preferably tapered front end 112*a* of strap 112, and parallel side walls 116*d* and 116*e*.

A locking cam generally indicated by the numeral 116*f* is located inside of latch assembly 116 and is connected to bottom side 116*g* of top 116*a*. Locking cam 116*f* has ratchet teeth 116*h* which mate with ratchet teeth 118 as shown in FIGS. 14 and 15 and prevent strap 112 from moving backward from latch assembly 116 when inserted therein.

A soft, flexible sleeve generally indicated by the numeral 300 is connected at base end 302 to rectangular base 114*c* of pocket portion 114 and is preferably integrally formed therewith. Sleeve 300 loosely encloses strap 112 to prevent strap 112 and the edges of strap 112 from contacting and irritating or injuring the skin of the wrist or ankle of a baby having bracelet 210 attached thereto. The distal end 304 of sleeve 300 is open or hollow to enable the distal end 304 to contact latch assembly 116 and slide or compress over strap 112 as strap 112 is forced into pocket 132 to attach bracelet 210 to a baby or mother. Sleeve 300 is preferably accordion-like in shape, having a plurality of adjacent ridges 300*a* and valleys 300*b* therein to enable sleeve 300 to easily be compressed and return to its original length after compression.

Baby identification bracelet 210 is attached to one wrist, and preferably one ankle of the baby, as shown for bracelet 10 in FIG. 6. To attach the baby identification bracelet to the wrist or ankle of a baby, the base 114*c* of the pocket portion of the bracelet 210 is placed against the wrist or ankle of a baby, the strap 112 is wrapped around the wrist or ankle of the baby, and the end 112*a* of the strap is inserted into opening 116*b* in latch assembly 116 and extended through latch assembly 116 until the end 112*a* of strap 112 inters pocket 132 as indicated in FIGS. 15 and 16. The end 112*a* of strap 112 is then pushed into pocket 132 until bracelet 210 is fitted snugly around the wrist or ankle of the baby. If the outside diameter of the flesh around the wrist and/or ankle of baby upon which bracelet 210 is placed decreases after placement of the bracelet 210 thereon, the bracelet may be easily tightened by pushing strap 112 farther through latch assembly 116 into pocket 132 to tighten bracelet 210 snugly around the wrist and/or ankle of the baby. Bracelet 210 cannot be removed from the baby except by cutting as described below.

Bracelets 210 may be packaged together in groups of three and four bracelets in a manner identical to bracelet 10 shown in FIGS. 4 and 5.

Preferably, elongated flexible fastening strap 112, pocket portion 114, flap 114*b*, and latch assembly 116 are made from a flexible plastic material such as a thermoplastic or thermosetting organic polymer.

As will be understood from the above description of the invention, the present invention has the advantage of enabling attachment of an identification bracelet to a baby quickly and easily, and enables the bracelet to be tightened if the flesh around the wrists or ankles of the baby decrease in outside diameter. Furthermore, the bracelet of the invention has the advantage of being removable from the baby only by cutting the bracelet. Additionally, one embodiment of the invention has the advantage of enabling an identification card and identification number to be quickly and easily detached from a bracelet removed from a baby and attached to the bracelet of the invention for placement on the same baby, thereby eliminating the need to place new identification cards and identification numbers on the baby and mother when an identification number is removed from a baby. Finally, the bracelet of invention is provided in groups having four bracelets which enable the father of the baby to wear one of the numbered bracelets and provide the father with the same identity link to the baby as that possessed by the mother.

Although the preferred embodiments of the invention have been described in detail above, it should be understood that the invention is no sense limited thereby, and its scope is to be determined by that of the following claims:

What is claimed is:

1. A baby identification system comprising a plurality of identical identification bracelets for attachment to at least one of the wrist and ankle of a baby and to the wrist and ankle of another person, each of the identification bracelets comprising:

a. a pocket portion for receipt of an identification card for the baby, the pocket portion having a generally rectangular base, the pocket portion having i. a top side and a bottom side for placement against the ankle and wrist of the baby, ii. a flap connected to the top side of the base for receiving and holding the identification card, the flap being open at one end for receipt of the identification card, b. a flexible fastening strap connected to the pocket portion, the flexible fastening strap having a plurality of ratchet teeth thereon, c. a hollow flexible sleeve for enclosing a portion of said flexible fastening strap connected to the pocket portion to prevent irritation of the arm and ankle of the baby, and d. a hollow latch assembly for receiving and securing the flexible fastening strap around the wrist and ankle of the baby, the latch assembly having a hollow portion therein and a locking cam located in the hollow portion of the latch assembly, the locking cam having a plurality of locking teeth thereon which engage the ratchet teeth on the fastening strap when the fastening strap is extended through the hollow portion of the latch assembly, to enable the fastening strap to be moved in one direction only therein to tighten the fastening strap about a wrist or ankle of the baby and prevent the fastening strap from being loosened on a wrist or ankle of the baby.

2. The baby identification system of claim 1 wherein said locking cam is elongated.

3. The baby identification system of claim 2 wherein said latch assembly has a top, said top having a bottom side, and said elongated locking cam extends downward from said bottom side of said top of said latch assembly.

4. The baby identification system of claim 1 wherein four of the identification bracelets are connected together in a package from which each of the identification bracelets can be separated from each other by the fingers of the user.

5. The baby identification system of claim 1 wherein said sleeve has a plurality of adjacent peaks and valleys.

6. The baby identification system of claim 1 wherein said sleeve is accordion-shaped.

* * * * *